US005461207A

United States Patent [19]

Van Lear

[11] Patent Number: 5,461,207

[45] Date of Patent: Oct. 24, 1995

[54] HAND HELD ACTUATOR FOR A PATIENT CALL SYSTEM

[75] Inventor: Jeffery D. Van Lear, Jacksonville, Fla.

[73] Assignee: Dwyer Precision, Inc., Jacksonville, Fla.

[21] Appl. No.: 64,635

[22] Filed: May 20, 1993

[51] Int. Cl.[6] ..... H01H 37/38

[52] U.S. Cl. ..... 200/81 H; 200/837; 200/302.2

[58] Field of Search ..... 200/81 R, 83 R, 200/83 Z, 83 P, 81 H, 302.2, 331, 333, 505; 73/715, 716, 717, 729, 730

[56] References Cited

U.S. PATENT DOCUMENTS

| | | | |
|---|---|---|---|
| 3,465,112 | 9/1969 | Reichert et al. | 200/83 |
| 3,736,836 | 6/1973 | McAllister | 89/1.814 |
| 3,781,843 | 12/1973 | Harrison et al. | 340/279 |
| 3,823,285 | 7/1974 | Dwyer | 200/81 H |
| 3,879,593 | 4/1975 | Larson | 200/159 B |
| 4,127,758 | 11/1978 | Lowthorp | 200/340 |
| 4,260,862 | 4/1981 | Orcutt | 200/81 R |
| 4,298,778 | 11/1981 | Beresford-Jones | 200/302 |
| 4,298,863 | 11/1981 | Natitus et al. | 340/573 |
| 4,647,738 | 3/1987 | Diamond | 200/81 H |
| 4,754,107 | 6/1988 | Tracey | 200/83 P |
| 5,118,909 | 6/1992 | Husting | 200/81 H |
| 5,155,309 | 10/1992 | Dwyer | 200/81 H |

FOREIGN PATENT DOCUMENTS

| | | | |
|---|---|---|---|
| 1299432 | 12/1972 | United Kingdom | F15B 7/00 |

*Primary Examiner*—A. D. Pellinen
*Assistant Examiner*—Michael A. Friedhofer
*Attorney, Agent, or Firm*—Clifford A. Poff

[57] ABSTRACT

A hand held actuator comprises a truncated conical housing wherein the volume of air is pressurized by flexure of a diaphragm. A rib protruding from an outer peripheral margin of the diaphragm is received in a groove of a support plate unwanted flexure of the peripheral margin is obtained by supporting the edges of the diaphragm and the plate in spaced apart grooves formed in the interior wall of the housing. The volume of air pressurized by the operation of the diaphragm is communicated by a duct to a signal switch. In one embodiment the duct is connected in a fluid type manner to the interior of the housing by the tapered sleeve. In another embodiment, the duct is joined to a tube forming an extension in an opening in the support plate forming a diaphragm.

6 Claims, 2 Drawing Sheets

HAND HELD ACTUATOR FOR A PATIENT CALL SYSTEM

BACKGROUND OF THE INVENTION

1. Field of the Invention

This invention relates to an actuator for operating a pneumatically actuated switching device and more particularly to an actuator having a truncated conical housing forming an internal cavity wherein a flexible diaphragm is supported by a peripheral rib while stabilized by an edge anchor for delivering pressurized air to a remote site for triggering a switching device to produce an electrical signal in a nurse call system.

2. Description of the Prior Art

A pneumatically actuated bulb device is known in the art for a patient actuated nurse call system. An example of such a device is disclosed in U.S. Pat. No. 3,823,285 and includes deformable pneumatic bulb to provide a source of pressurized air to operate an electrical switching circuit that is well suited for use in environments where it is undesirable to use a conventional electrical switch. The possibility exists of a catastrophic explosion when a conventional electrical make-break switching circuit operates in an atmosphere containing a high concentration of a potentially explosive gas. Such an atmosphere commonly occurs in hospital rooms due to a patient's use of oxygen. A patient actuated call system is not only commonly used in hospital rooms but also in other health care facilities where there is a need or desire to summon personnel for help, particularly, when a patient is in a weakened or disabled condition. Most hospitals and health care institutions have signalling systems by which in each patient area, a patient may initiate a signal that is received at a station or at an allocated substation within a larger area to summon assistance. Typically, for example, in a hospital a select group of patient areas is serviced by a given nurse station where calls for assistance by patients are taken. Most patient areas must accommodate the use of oxygen even if it is only on an emergency basis whereby electrical switches commonly used in other industries can not be utilized. The pneumatically operated switch disclosed in the aforesaid U.S. Pat. No. 3,823,285 provides an entirely satisfactory solution to the need for a pneumatically activated switching device which can operate in a very reliable fashion in hostile environments particular atmospheres containing a high concentration of oxygen that could otherwise cause combustion. However, the deformable bulb for supplying pneumatic pressure is susceptible to improvements. As disclosed, the bulb is manufactured in one piece by an injection molding technique to avoid seams and thereby prevent leakage. A need exists for a pneumatic pressurizing device less susceptible to false triggering as can occur by any source of pressure on the bulb. Also, the pressurizing device needs to be better suited for the environment of use particularly by the selection of materials to withstand the vigorous use and abuse in the patient environment and at the same time embody a construction necessary to economic and reliability factors. In a more recent development of a pressurizing device, there is disclosed in U.S. Pat. No. 5,155,309, a pneumatic bulb embodying a generally annular ring configuration with a convexly shaped actuator dome resembling a doughnut appearance to provide a distinctive identification to the bulb for distinction from other pneumatic bulbs that may be utilized for different purposes in a patient area. The construction of the pneumatic bulb included a base plate to provide a broad area of support for the bulb and support for a peripheral rim and a center post of the doughnut shaped actuator dome. The base plate included protruding truncated conical members relied upon to maintain the doughnut shaped actuator at a fixed or pre-established location on a patient's mattress so that the patient can reliably find the bulb to summon help.

Examples of other known nurse call systems can be found in U.S. Pat. Nos. 4,702,443; 4,484,367; 4,298,863; and 3,781,843. In U.S. Pat. No. 4,702,443, a cord holding device is disclosed wherein a belt fastener is used to hold a base onto a mattress so that the base can in turn receive a cord holding member. The cord holding member supports a cord to allow limited movement of the cord the end of which carries a push button electric switch. In U.S. Pat. No. 4,484,367, a side rail of a patients bed is wrapped with a flexible sheet having a pocket in one side of the sheet for receiving an electronic push button device serving as a call device for summoning a nurse. U.S. Pat. No. 4,298,863 discloses a patient call system in which a patient operated transducer is mounted on a patients face or a portion of the body. The transducer is interconnected by pneumatic tubing to an pneumatically actuated switch that is part of an electronic monitoring system. U.S. Pat. No. 3,781,843 discloses a bed guard system in which the upper rail surfaces of patient restraining rails at opposite sides of a bed are fitted with a detector. Each detector is formed with an elongated rail engaging pocket shape to fit on the rail surface and an overlying elongated internal cavity extending generally the length of the rail. The internal cavity forms a site for a fluid material which can be pressurized by an applied pressure to the top surface of the rail covering.

SUMMARY OF THE INVENTION

It is an object of the present invention to provide a hand held actuator having a compact rigid shape that can be easily found and grasped in a person's hand without the mass otherwise required to keep an actuator at a desired fixed location.

It is another object of the present invention to provide a hand held pneumatic actuator having a truncated conical shape embodying a rigid side wall construction that will allow actuator to remain impervious to external pressure in a designated area with great reliability and integrity while supporting a diaphragm operative to control a switching device to summon help or assistance by a patient in an area.

It is a further object of the present invention to provide a construction and arrangement of parts to impart rigidly to a peripheral rim of a flexible diaphragm and thereby avoid stressing a sealing rim when the diaphragm is flexed.

More particularly, according to the present invention there is provided a system having a signal switch responsive to a remote actuator, the remote actuator comprises a flexible fluid impervious diaphragm having a rib upstanding from an outer peripheral margin perpendicular to an edge anchor, and a housing including a base having an annular socket for receiving the rib in a fluid tight manner to form a chamber in the housing for pressurizing a fluid medium by deformation of the diaphragm, the housing further including means engageable with the edge anchor to impart a rigid stabilizing support to the outer peripheral margin for resisting flexing of the rib during operation of the diaphragm to pressurize the fluid medium in the housing.

Preferably the housing is joined to a duct by a tapered sleeve in an airtight manner to apply a pressurized volume of air within the housing to a remotely situated signal switch. In a further embodiment of the present invention the aforesaid base takes the form of a rigid disk having a duct extending centrally from a surface at one side thereof for connection with a tube that delivers pressurized air developed by the diaphragm to the remote signal switch.

DESCRIPTION OF THE DRAWINGS

These features and advantages as well as others will be more fully understood when the following description is read in light of the accompanying drawings in which.

DETAILED DESCRIPTION OF THE PREFERRED EMBODIMENTS

Figure 1:
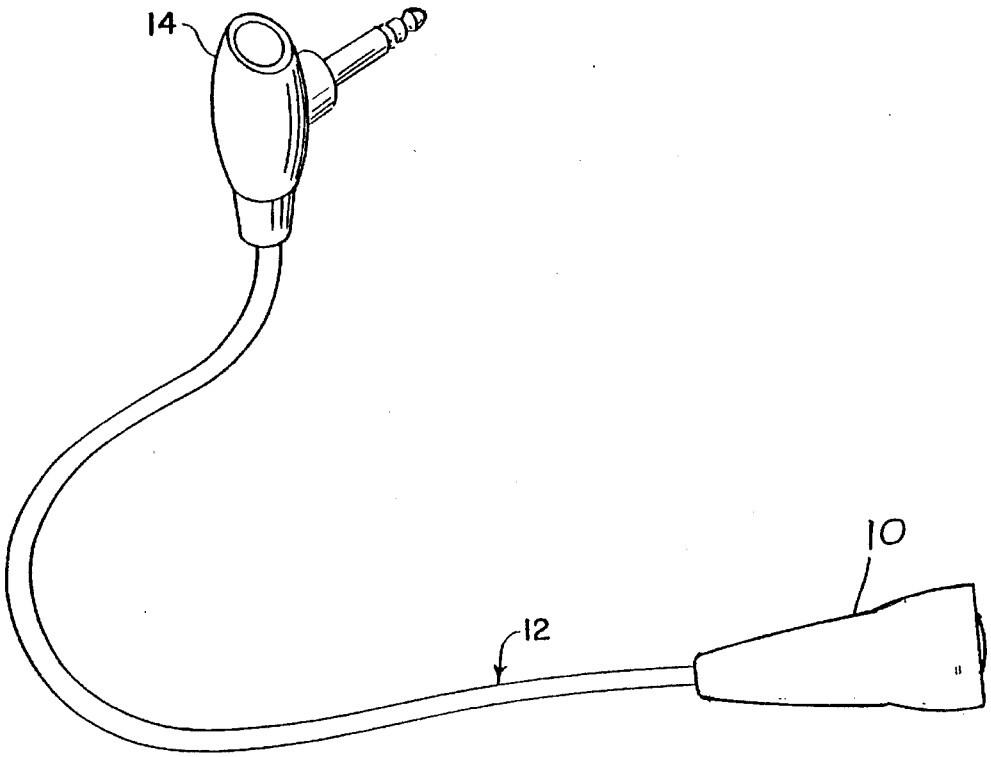
FIG. 1 is a perspective view of a pneumatically actuated switching device utilizing the improved hand held pneumatic actuator according to the present invention.
Figure 2:
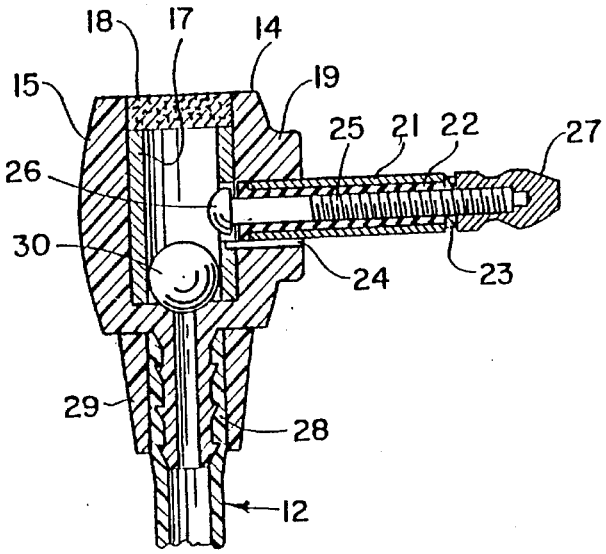
FIG. 2 is an enlarged sectional view of the pneumatically actuated switching device as shown in FIG. 1 with the actuator ball in a position for an open circuit.

In FIG. 1 there is illustrated the preferred embodiment of the present invention in which a hand held actuator 10 is connected by an air conduit 12 to a pneumatically actuated switching device 14 that is in turn connected electrically with a circuit, not shown, at some remote site for producing an alarm signal that is detected by personnel, such as a nurse. The present invention is particularly useful in a nurse call system utilized by patients to summon help for assistance or fulfill a need for patient care. The switch device 14 is shown in greater detail in FIGS. 2 and 3 and includes an actuator housing 16 having an internal annular cavity for supporting a sleeve 17. The sleeve 17 seats against a bottom wall of the cavity in the housing 16. The top of the cavity is enclosed by a porous air filter 18. Emerging through an opening surrounded by an enlarged boss 19 in a side wall of the housing 16 there is a tubular conductor 21 having internally thereof an insulating sleeve 22. Each of opposite ends of the sleeve 22 is formed with an enlarged radial flange 23 that anchors the sleeve 22 within sleeve 21. A conductor pin 24 electrically interconnects sleeve 17 with sleeve 21. A conductor pin 25 is supported in the central opening of insulating sleeve 22 and provided with a hemispherical electrical contact 26 that is situated within a side wall opening of sleeve 17 in a manner that contact 26 protrudes a slight distance beyond the internal wall face of sleeve 17. Connector 25 is provided with a threaded end portion that extends beyond the insulating sleeve 22 and receives a metal connector 27.

A supply of pressurized air is delivered by conduit 12 to an entry duct 28 which comprises an extension of the housing 16. The entry duct has an external surface formed with anchor lugs that can firmly grip by partial penetration of the internal wall face of duct 12 in order to maintain an air tight connection between duct 12 and duct 28. A collar 29 is passed over the external surface of the duct 28 to apply a compressive force to the duct and reinforce the conduit side wall. The internal cavity wherein sleeve 17 is supported in housing 16 is provided with a truncated conical seat surrounding the supply opening in the duct 28 for allowing an actuator ball 30 to seat by gravity against the truncated conical seating surface.

Figure 3:
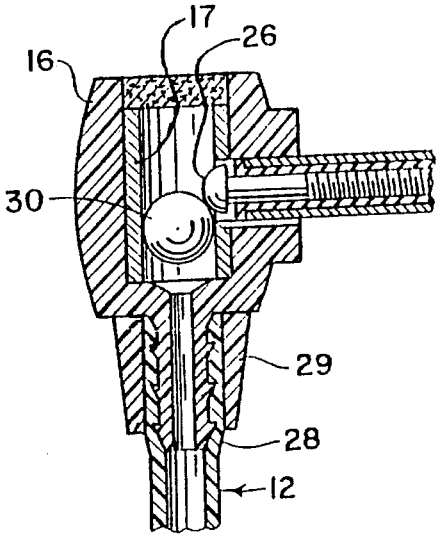
FIG. 3 is a sectional view similar to FIG. 2 and illustrating the actuator ball in a closed circuit position.

As shown in FIG. 3, the actuator ball which can be of a solid metal construction or of a non-metallic core provided with a metallic covering can be displaced from the conical seat through the delivery of a quantity of pressurized air through duct 28 into the area surrounded by the sleeve 17. The ball 30 is displaced by the air from the conical seat into a electrically conductive relationship between the hemispherical head portion 26 of conductor 25 and the sleeve 17. When this occurs, the normally opened circuit condition as depicted by the arrangement of parts in FIG. 2 becomes a normally closed circuit condition as depicted by the arrangement of parts in FIG. 3 and thereby provides a corresponding electrical signal which is detectable by the call system to which the switching device 14 is connected.

Figure 4:
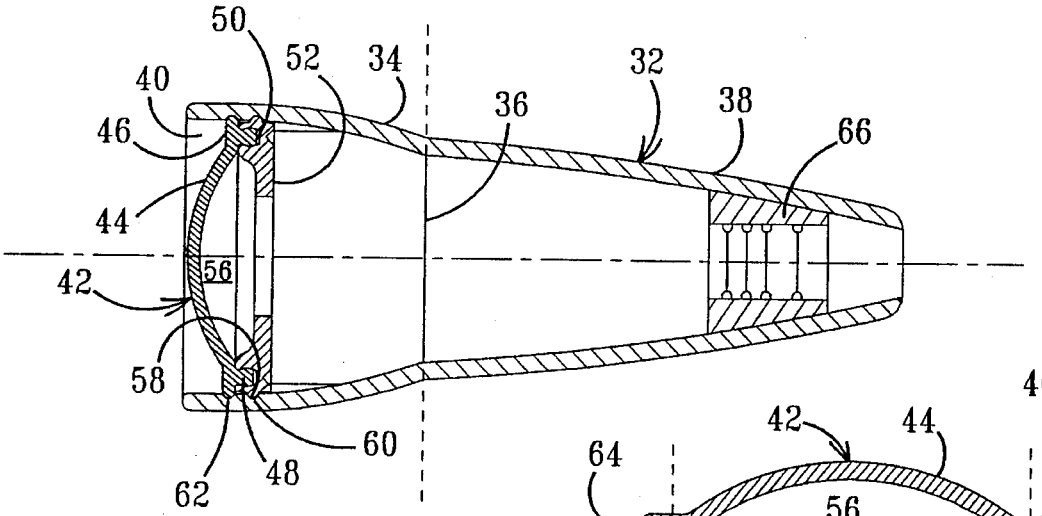
FIG. 4 is a sectional view taken along the length of the hand held pneumatic actuator shown in FIG. 1.
Figure 5:
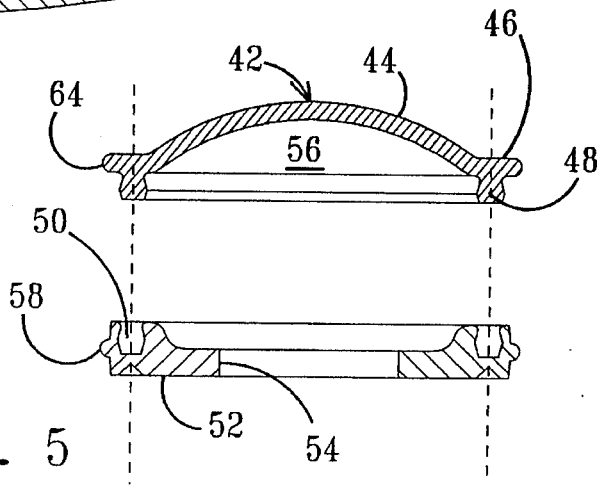
FIG. 5 is an exploded view of the diaphragm and a support plate forming part of the actuator shown in FIG. 4.

The preferred embodiment of a hand held pneumatic actuator 10 as shown in FIGS. 4 and 5 includes a housing 32 which takes the form of a truncated conically shaped member open at opposite ends and comprised of a side wall made of rigid plastic material such as, for example, pvc (or polyvinyl chloride). The tapering shape of the housing is made up of a first portion having a cup shaped side wall 34 merging at a demarcation plane 36 with elongated funnel shaped sidewall 38. The tapering shape of the housing can be complimented by suitable dimensioning to allow a person to grasp the housing within the palm of the hand with ease and comfort. The side wall at the enlarged end of the cup shaped portion 34 forms an annular pocket 40 extending to a flexible fluid impervious diaphragm 42. Diaphragm 42 is comprised of a dome-shaped central portion 44 merging with an outer annular rim portion 46. The rim portion has an upstanding rib 48 with a central bulge, as shown in FIGS. 4 and 5 that can snap fit into an annular socket 50 formed in a base 52. The base 52 has a central opening defined by annular walls 54 to allow communication of a pneumatic pump chamber 56 with the remaining enclosed interior of the housing 32. The base 52 is preferably made of rigid plastic material and is formed with a disk-like configuration having an edge rib 58 protruding from the outer edge for reception in a correspondingly shaped first groove 60 which takes the form of a curved recess in the internal face of the cup shaped side wall 34. Outwardly spaced from the first groove is a second groove 62 having a similar curved configuration for receiving an edge rim 64 that protrudes from the rim portion 46. The arrangement of parts is such that rib 48 is snugly fit under a slight compressed force in socket 50 to establish a fluid tight connection which is maintained with long continued integrity by the avoidance of flexure between rib portion 48 and socket 50. The avoidance of flexure is attributed to support imparted to rim portion 46 by an interlocking of the edge rim 64 and the second groove 62 forming an edge anchor. In this way the edge anchor imparts rigid, stabilized support to the outer peripheral margin of the diaphragm that functions as a support to resist flexing of the rib during elastic deformation of the central portion 44. The reduced diameter of the truncated shape of the housing 32 forms a site wherein there is received a tapered sleeve 66 that has a cylindrical cavity to receive and secure the duct 12 in a fluid type manner. The sleeve 66 may be adhesively attached to the housing and the duct adhesively attached to the sleeve, if desired, to assure that the pressure imparted to the volume of air inside the housing by deformation of the diaphragm is applied by the duct to the cavity within switch 14. As shown in FIG. 4, the opening in the terminal end of side wall 38 is of a size for forming an air tight relation between the outer surface of tube 12 and internal wall surface 68 of side wall 38.

Figure 6:
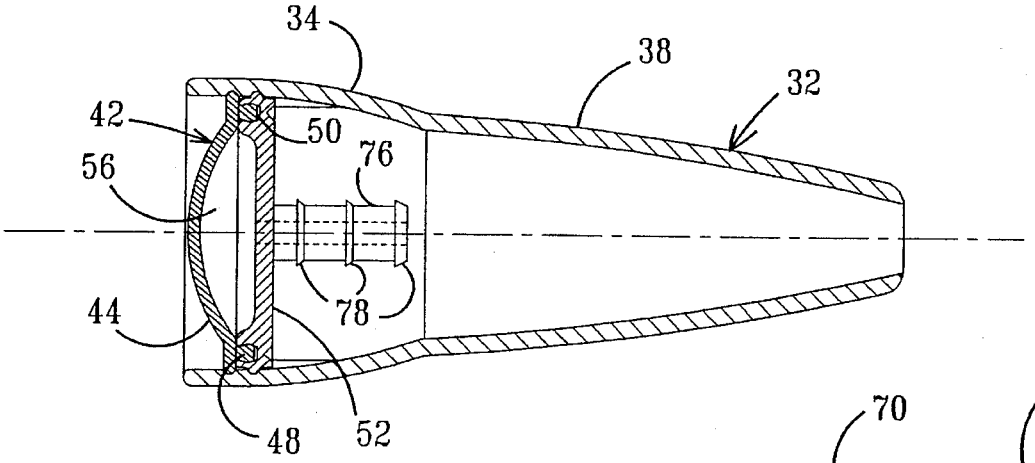
FIG. 6 is a sectional view similar to FIG. 4 and illustrating a second embodiment of the hand held actuator according to the present invention.
Figure 7:
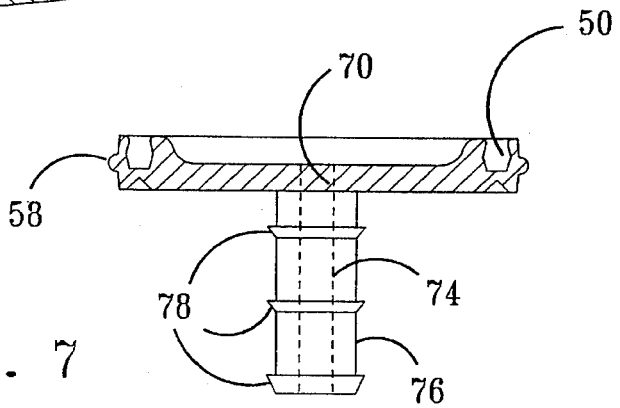
FIG. 7 is a sectional view of the support plate forming part of the embodiment of the actuator shown in FIG. 6.

The embodiment of the hand held pneumatic actuator shown in FIGS. 6 and 7 differs from that described and shown in FIGS. 4 and 5 by the construction of the base plate used to support the diaphragm. Accordingly, like reference numerals in FIGS. 4 and 5 and FIGS. 6 and 8 identify identical elements. As shown in FIGS. 6 and 7, the base plate includes a central duct formed by an annular wall 70 which is extended by an internal wall 74 of a protruding annular tube 76. The tube 76 has anchor lugs 78 constructed in essentially the same manner as the anchor lugs in the outer surface 28 to firmly grip by partial penetration the internal wall surface of duct 12.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. In a system having a signal switch responsive to a remote actuator, said remote actuator comprising:

a flexible fluid impervious diaphragm having a rib upstanding from an outer peripheral margin of the diaphragm and perpendicular to an edge anchor; and a housing including a base having an annular socket for receiving said rib in a fluid tight manner to form a chamber in said housing for pressurizing a fluid medium by deformation of said diaphragm, said housing further having first and second spaced apart grooves, said first groove receiving said edge anchor to impart rigid stabilizing support to said outer peripheral margin of said diaphragm for resisting flexing of said rib during operation of said diaphragm to pressurize the fluid medium in said housing, said second groove receiving an edge portion of said base.

2. The system according to claim 1 further including a tapered sleeve for joining said housing by a duct to said signal switch.

3. The system according to claim 2 wherein said base includes annular walls to apply a pressurized volume of air by said diaphragm within the housing to said signal switch.

4. The system according to claim 1 wherein said base takes the form of a rigid disk having means for discharging a pressurized fluid means by said diaphragm to said signal switches.

5. The system according to claim 4 wherein said means includes a duct extending from a central face area at one side of the rigid disk for connection with a tube that delivers pressurized air developed by the diaphragm to the signal switch.

6. The system according to claim 1 wherein said first and second spaced apart grooves are formed in a cup shaped side wall forming part of said housing.

* * * * *